US010955207B1

(12) United States Patent
Puleo

(10) Patent No.: US 10,955,207 B1
(45) Date of Patent: Mar. 23, 2021

(54) FLAT LOOP REVOLVING FIREARM ASSEMBLY

(71) Applicant: Nicholas Puleo, Easley, SC (US)

(72) Inventor: Nicholas Puleo, Easley, SC (US)

( * ) Notice: Subject to any disclaimer, the term of this patent is extended or adjusted under 35 U.S.C. 154(b) by 0 days.

(21) Appl. No.: 17/111,081

(22) Filed: Dec. 3, 2020

Related U.S. Application Data

(60) Provisional application No. 62/947,258, filed on Dec. 12, 2019.

(51) Int. Cl.

| | |
|---|---|
| ***F41A 9/79*** | (2006.01) |
| ***F41A 9/30*** | (2006.01) |
| ***F41A 9/47*** | (2006.01) |
| *F42B 5/02* | (2006.01) |
| *F41A 5/16* | (2006.01) |

(52) U.S. Cl.
CPC *F41A 9/47* (2013.01); *F41A 9/30* (2013.01); *F41A 9/79* (2013.01); *F41A 5/16* (2013.01); *F42B 5/02* (2013.01)

(58) Field of Classification Search
CPC ..... F41A 9/76; F41A 9/79; F41A 9/47; F41A 5/16; F41A 5/02; F41A 9/30; F41A 9/29
USPC ... 89/33.03, 33.1, 33.14, 33.16, 33.17, 33.2, 89/33.25; 42/49.01, 50
See application file for complete search history.

(56) References Cited

U.S. PATENT DOCUMENTS

| | | | | | |
|---|---|---|---|---|---|
| 630,758 | A | * | 8/1899 | Turnbull | F41A 17/38 42/7 |
| 672,300 | A | | 4/1901 | Turnbull | |
| 2,057,169 | A | * | 10/1936 | Swenson | F41A 9/76 42/5 |
| 4,037,344 | A | * | 7/1977 | Reed | F41A 9/58 42/16 |
| 4,452,123 | A | | 6/1984 | Holtrop | |
| 4,468,875 | A | * | 9/1984 | Harrison | F41A 9/76 42/50 |
| 4,777,863 | A | * | 10/1988 | De Haven | F41A 9/21 89/33.1 |
| 4,862,622 | A | * | 9/1989 | Goyanes | F41A 9/85 42/89 |
| 5,054,365 | A | * | 10/1991 | Wissing | F41A 3/74 89/24 |
| 5,295,320 | A | | 3/1994 | Svensson | |
| 5,299,373 | A | | 4/1994 | Breiner | |
| 5,566,487 | A | | 10/1996 | Vaid | |
| 6,029,557 | A | * | 2/2000 | Sulm | F41A 9/30 89/33.14 |

(Continued)

FOREIGN PATENT DOCUMENTS

| | | | | | |
|---|---|---|---|---|---|
| GB | 1243012 | A | * | 8/1971 | F41A 9/76 |

*Primary Examiner* — Jonathan C Weber
(74) *Attorney, Agent, or Firm* — Joseph T. Guy; Kirk A. Wilson; Patent Filing Specialist Inc.

(57) ABSTRACT

A flat loop revolving firearm assembly can have a trigger mechanism configured to move a loop advance lever disposed between the trigger mechanism and a flat loop, and a hammer retractor lever disposed between the trigger mechanism and at least one hammer retractor bar. The hammer retractor bar can be configured to slide and contact a hammer thereby rotating the hammer to a cocked position and releasing the hammer to fire a cartridge removably disposed in a firing position chamber. The flat loop can have a plurality of flat loop links configured to revolve in parallel tracks into a firing position in response to motion imposed by the loop advance lever.

20 Claims, 8 Drawing Sheets

(56) References Cited

U.S. PATENT DOCUMENTS

| | | | | |
|---|---|---|---|---|
| 6,345,562 | B1 * | 2/2002 | Mannhart | F41A 9/04 89/33.16 |
| 7,617,758 | B2 | 11/2009 | Gavage | |
| 7,765,997 | B2 * | 8/2010 | Klockener | F41B 11/62 124/48 |
| 7,934,443 | B1 * | 5/2011 | Bennett | F41A 9/79 89/33.14 |
| 8,820,212 | B2 * | 9/2014 | Rostocil | F41A 11/02 89/155 |
| 8,875,433 | B2 | 11/2014 | Beckman | |
| 9,612,081 | B2 * | 4/2017 | Maeda | F41B 11/55 |
| 10,371,473 | B1 * | 8/2019 | Wei | F41B 11/55 |
| 2011/0000117 | A1 | 1/2011 | Garavaglia | |
| 2012/0144712 | A1 * | 6/2012 | Rostocil | F41A 9/79 42/16 |
| 2016/0025446 | A1 * | 1/2016 | Maeda | F41A 9/46 124/45 |

* cited by examiner

FLAT LOOP REVOLVING FIREARM ASSEMBLY

CROSS-REFERENCE TO RELATED APPLICATIONS

The present invention claims priority to U.S. Provisional Patent Application No. 62/947,258, filed Dec. 12, 2019, which is incorporated herein by reference in its entirety.

FIELD OF THE INVENTION

The present invention is related to a Safe, Silent and Ready to Send (SSRS) firearm assembly, preferably a handgun which combines the advantages, and eliminates the disadvantages, of each of the two main designs for handguns, revolvers and semi-automatic pistols (SAP's) into one product.

BACKGROUND

The main advantages of revolvers include that they are dependable, reliable, ready to fire when loaded and easy to operate. The main advantages of SAP's include increased capacity and a smaller, narrower frame making them easier to carry, especially when concealed.

The disadvantages of revolvers include that they are bulky, making them harder to carry, especially when concealed, and have a limited capacity, usually just six rounds. The disadvantages of SAP's include that they more difficult and time consuming to operate, requiring the extra step of operating the slide after loading and before firing. SAP's can jam when ejecting spent rounds or feeding the next round. SAP's also force the user to decide whether to carry the firearm 'with or without' a round in the chamber, 'without' causing a delay to operate the slide when deploying the weapon which can be critical in a defensive situation with an adversary, and 'with' carrying it with the hammer retracted, which can create safety concerns, with or without a safety mechanism, by enabling accidental firing.

U.S. Pat. Nos. 672,300 to Turnbull; U.S. Pat. No. 4,452,123 to Holtrop and U.S. Pat. No. 5,295,320 to Svennson are herein incorporated by reference in their entirety. None of these references have a truly "flat" loop, especially Turnbull, which is very bulky and similar to a standard revolver. Holtrop and Svensson also have many larger and complicated internal mechanisms making these difficult to adapt for a compact hand gun with rounds in handle. Svensson contains more than 20 moving parts, including gears, to engage the hammer and advance the loop, thereby making it more complicated and less reliable.

SUMMARY OF THE INVENTION

An embodiment of a flat loop revolving firearm assembly can have a trigger mechanism configured to rotate about a trigger central pin and move a loop advance lever and a hammer retractor lever, the loop advance lever disposed between the trigger mechanism and a flat loop, the hammer retractor lever disposed between the trigger mechanism and at least one hammer retractor bar. The at least one hammer retractor bar can be slidingly disposed between the hammer retractor lever and a hammer, the hammer retractor bar configured to slide and contact the hammer thereby rotating the hammer to a cocked position and releasing the hammer to fire a cartridge removably disposed in a firing position chamber. The flat loop can have a plurality of flat loop links, each link comprising an advancing lip and a chamber configured to revolve in parallel tracks into a firing position in response to motion imposed by the loop advance lever. A barrel can be aligned with the firing position chamber, and a gun stock can encase the entire flat loop revolving firearm assembly.

Another embodiment of a flat loop revolving firearm assembly can have a trigger mechanism configured to rotate about a trigger central pin and rotate a top sprocket to move a loop advance bar and a hammer retractor lever, the loop advance bar disposed between the top sprocket and a flat loop, the hammer retractor lever disposed between the trigger mechanism and at least one hammer retractor bar. The at least one hammer retractor bar can be slidingly disposed between the hammer retractor lever and a hammer, the hammer retractor bar configured to slide and contact the hammer thereby rotating the hammer to a cocked position and releasing the hammer to fire a cartridge removably disposed in a firing position chamber. The flat loop can have a sprocket retainer bar, the top sprocket, a bottom sprocket, and linked cartridges spanning between the top and bottom sprockets configured to revolve in parallel tracks into firing position in response to motion imposed by the loop advance bar. A barrel can be aligned with the firing position chamber, and a gun stock can encase the flat loop revolving firearm assembly.

Another embodiment of a flat loop revolving firearm assembly consists essentially of the elements listed above and may also include other elements that do not materially affect the basic and novel properties of the assembly. In yet another embodiment, a flat loop revolving firearm assembly consists of the elements listed above and nothing more.

DETAILED DESCRIPTION

Figure 1:
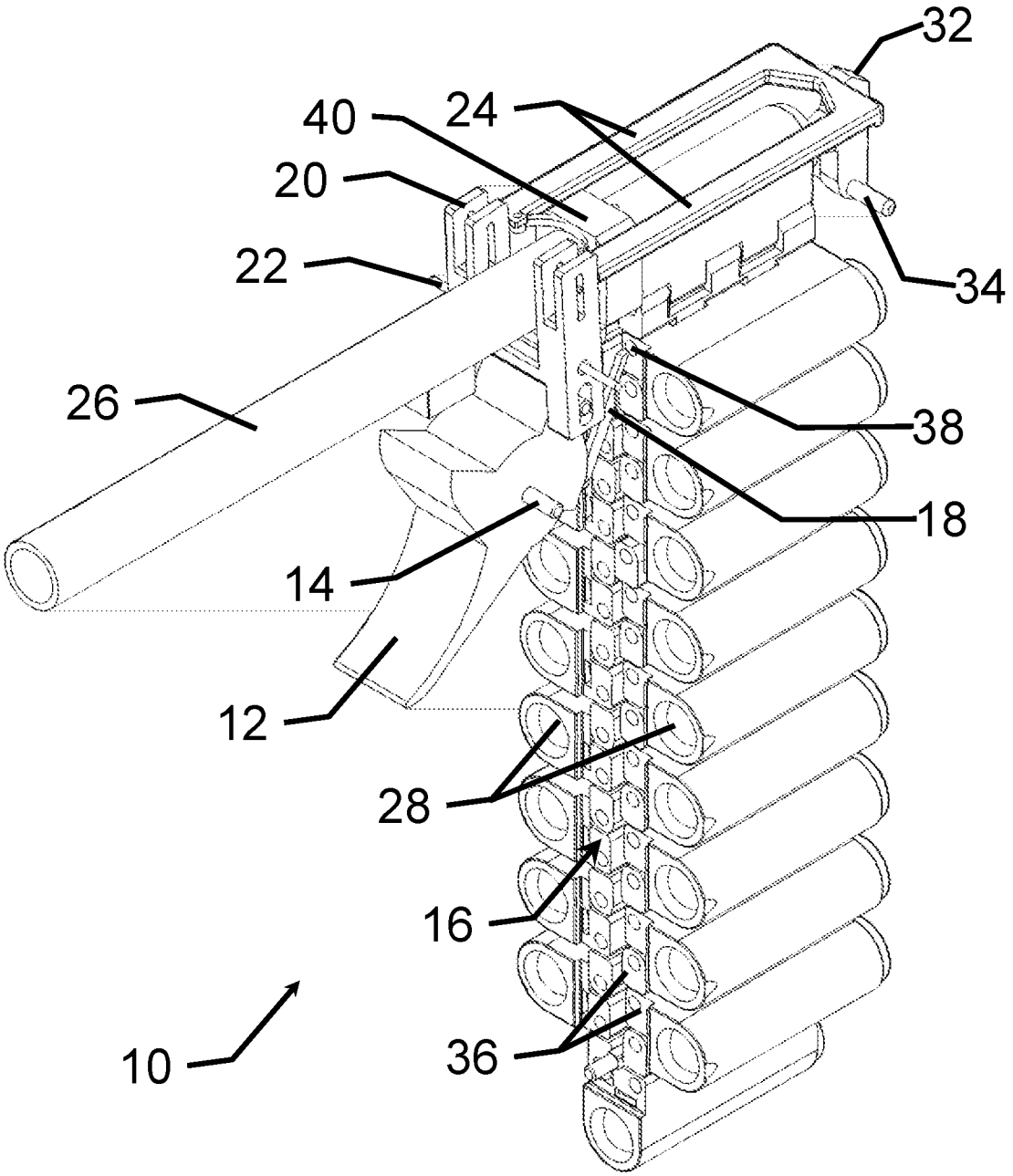
FIG. 1 is a perspective view of one embodiment of the flat loop revolving assembly.

The term "firearm" is defined herein as any weapon including but not limited to rifles, shotguns, pistols, handguns, and revolvers.

The SSRS flat loop revolving firearm (FLR) assembly disclosed herein eliminates the disadvantages described above and has all of the advantages of revolvers and semi-automatic pistols (SAP) by having a narrow frame, high capacity, readiness, dependability, and safety while carrying or storing when loaded. The FLR has the additional and significant extra benefit of increased range, power and accuracy. Instead of a round, fixed and bulky cylinder, as in a standard or traditional revolver, the FLR has a flat, narrower loop (see FIGS. 1-9) holding the rounds in a configuration that fits into the handle of the gun, similar to a magazine in a SAP. This results in a "revolver" with the increased capacity of up to 20 rounds or more. The FLR is easier to operate and ready to fire when loaded as there is no slide to operate, as with a SAP. This has advantages in tactical situations, such as saving time in a defensive situation, or when confronting a nighttime home intruder, since it not only saves time but also does not make an audible clicking noise that could alert the intruder.

The FLR has the dependability and reliability of a revolver as the loop cannot jam when feeding the next round, unlike the cartridge ejection and feeding system or magazine, of a SAP. Additionally, the FLR is safer to carry, store or keep bedside when loaded because the hammer is concealed and not retracted, which can prevent accidental firing with or without a safety mechanism.

With the round positioned in the rear of the unit (see FIGS. 1-9) instead of in the middle or forward as with most revolvers and SAP's, more of the barrel is used increasing the time and distance the round travels in the barrel after firing. This will significantly improve ballistics with increased range, power and accuracy.

The SSRS FLR can be configured in various cartridge sizes, for example a small caliber (i.e. .22 LR, .22 Mag, .22 WMR or .380) pocket/purse carry gun, a mid-size (9 mm) general purpose and carry gun, a large caliber (.357 mag, .44, .45) full size gun, and alternately a shotgun or rifle. The FLR is safe because it has no magazine to jam. The user can carry the FLR without a racked round and without the hammer retracted, as in semi-auto pistols. The closed mechanism of the FLR is less susceptible to dirt and water and is more reliable. The FLR can have a permanent, interlocked firing sequence. The hammer is not exposed which prevents accidental firing from drops and strikes.

The FLR is silent in that there is no need to rack a round which makes noise. And, there is no need to use a safety which results in an audible "click", though it can be added if preferred. The FLR is ready as-is, with no need to rack a round. There is less concern for a safety and therefore one less step to fire more quickly. The revolver has an increased capacity over standard 6-shooter revolvers.

The SSRS FLR sends a round down-range from the chamber that is positioned behind the rear of the barrel, not in middle of gun as with semi-auto pistols and traditional revolvers, and the FLR uses the entire barrel length to enable higher muzzle velocity for longer range, greater accuracy. The barrel can be rifled as-needed.

As seen in FIGS. 1-4, the flat loop revolver 10 can have a trigger mechanism 12 similar to a traditional hand gun trigger, and can be installed with or without a trigger safety. The trigger mechanism 12 pivots on a trigger central pin 14 that can be secured to both sides of the stock (not shown). The front end of a loop advance lever 18 is pinned to the back of the trigger mechanism 12 and the back end slidingly engages with the flat loop 16 to advance the flat loop 16. A hammer retractor lever 20 pivots on a HRL pin 22. The hammer retractor lever 20 is slotted top and bottom to allow pins connected to the trigger mechanism 12 below and hammer retractor bars 24 above to slide. When the trigger mechanism 12 is pulled and rotated around the trigger central pin 14, the bottom of the hammer retractor lever 20 moves forward and top of the hammer retractor lever 20 slides backward thereby keeping the hammer retractor bars parallel to the intended travel path. There can be two hammer retractor bars 24, one on each side of the barrel 26, to increase strength, durability and reliability.

The loop advance lever 18 sequentially engages with a flat loop link 36 in the flat loop 16, each link 36 having a chamber 28 configured to sequentially revolve into firing position in response to motion imposed by the loop advance lever 18. The flat loop 16 sequentially advances each adjacent chamber 28 into a firing position by sequentially aligning the chambers 28 with the barrel 26. The trigger mechanism 12 motion allows the loop advance lever 18 to engage the flat loop 16 only after the hammer retractor lever 20 provides sufficient sliding motion for the hammer retractor bars 24 to push the hammer 32 back and away from the top cartridge 30. The delayed motion of the flat loop 16 is a mechanical offset indexed by the travel distance between engagement points of the loop advance lever 18 and the flat loop 16. After the flat loop 16 moves the top chamber 28 into loading position, the top chamber is disengaged by a ramp (not shown) built into the stock (not shown) allowing a positive locking mechanism 42 to lock the chamber 28 in alignment with the barrel 26. This allows the hammer retractor bars 24 to continue to fully retract the hammer 32 with the flat loop 16 and chamber 28 secured in place. The cocking portion of the hammer retractor bars 24 sliding motion rotates the hammer 32 backwards until it reaches a cocked position. The firing portion of the hammer retractor bars 24 sliding motion permits the arc-shaped travel of the hammer 32 to slip under the hammer retractor bars 24 and the hammer 32 is released to strike a cartridge 30. The hammer 32 is configured to strike the cartridge 30 in either a rim fire or center fire position, according to the required application. The configuration depicted is for a rim fire .22LR caliber application. Additional embodiments can include a firing pin for center fire applications. A hammer pivot pin 24 is attached to the rear folding door (see FIG. 4) so that it swings away from the top cartridge when opened to allow extracting the spent cartridge and reloading the top chamber. The hammer 32 is driven by a spring (not shown) behind it in sufficient force to fire the round. After firing, the hammer retractor bars 24 retract and glide over the top of the hammer 32 to allow the hammer retractor bars to return to their original position.

The barrel 26 can accommodate a .22LR cartridge or other cartridges as designed. The barrel 26 can be chrome lined for durability and rifled as per standard handgun specifications. Each chamber 28 holds one round and the configuration shown in FIGS. 1-4 is for 20 rounds of .22LR.

Essential to the flat loop revolver 10 is a flexible, flat, high capacity flat loop 16 that replaces the hard, fixed, bulky, low capacity (usually six rounds) traditional revolver cylinder. The flat loop 16 is configured to travel in parallel tracks and be as flat and thin as possible to save space within the grip of the flat loop revolver 10 while maintaining the required, strength, durability, safety and functionality for the application.

A blast containment ring 40 closes the small gap between the chamber 28 and barrel 26, to substantially reduce, if not totally prevent the fouling of the working parts of the flat loop revolver 10 by gases, soot, etc., most of which will in any case be expelled out of the barrel 26. An optional gas vent 43 may also be employed to further facilitate the expulsion of gases, especially in larger caliber models. The blast containment ring 40 also serves as a positive locking mechanism 42 which ensures that the hammer cannot be fully retracted and the unit fired unless the barrel 26 and chamber 28 are securely aligned.

Figure 2:
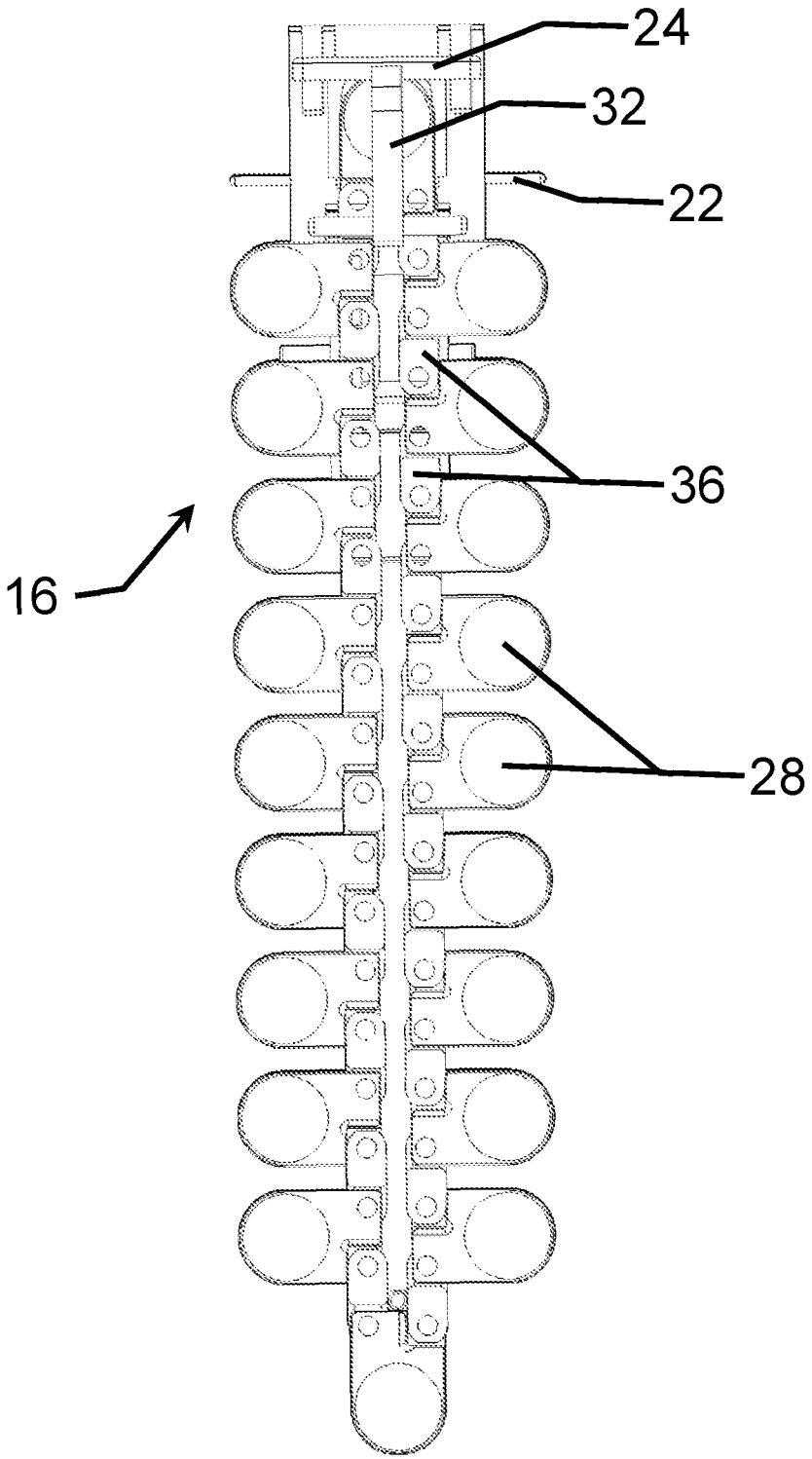
FIG. 2 is a rear view of one embodiment of the flat loop revolving assembly.

FIG. 2 illustrates a back view of the flat loop revolver 10 with the flat loop links 36 and associated chambers 28 aligned in parallel tracks underneath the hammer retractor lever 20, hammer retractor bar 24 and hammer 32.

Figure 3:
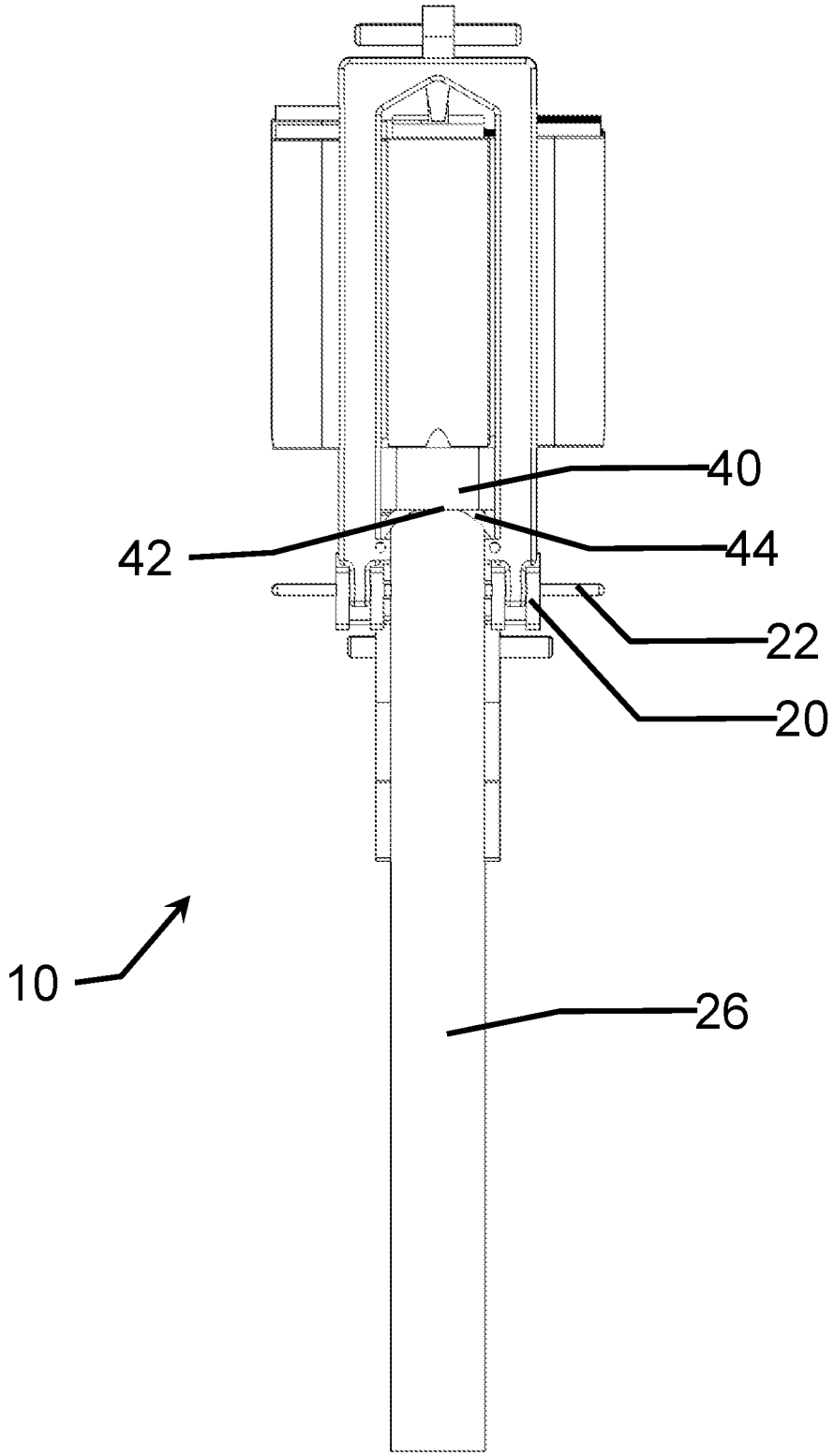
FIG. 3 is a top view of one embodiment of the flat loop revolving assembly.

FIG. 3 illustrates a top view of the flat loop revolver 10 showing the hammer retractor bar 24 in position to push back the hammer 32 and the alignment of the chamber 28 with the barrel 26 as secured by the positive locking mechanism 42, held in place by a spring behind it.

Figure 4:
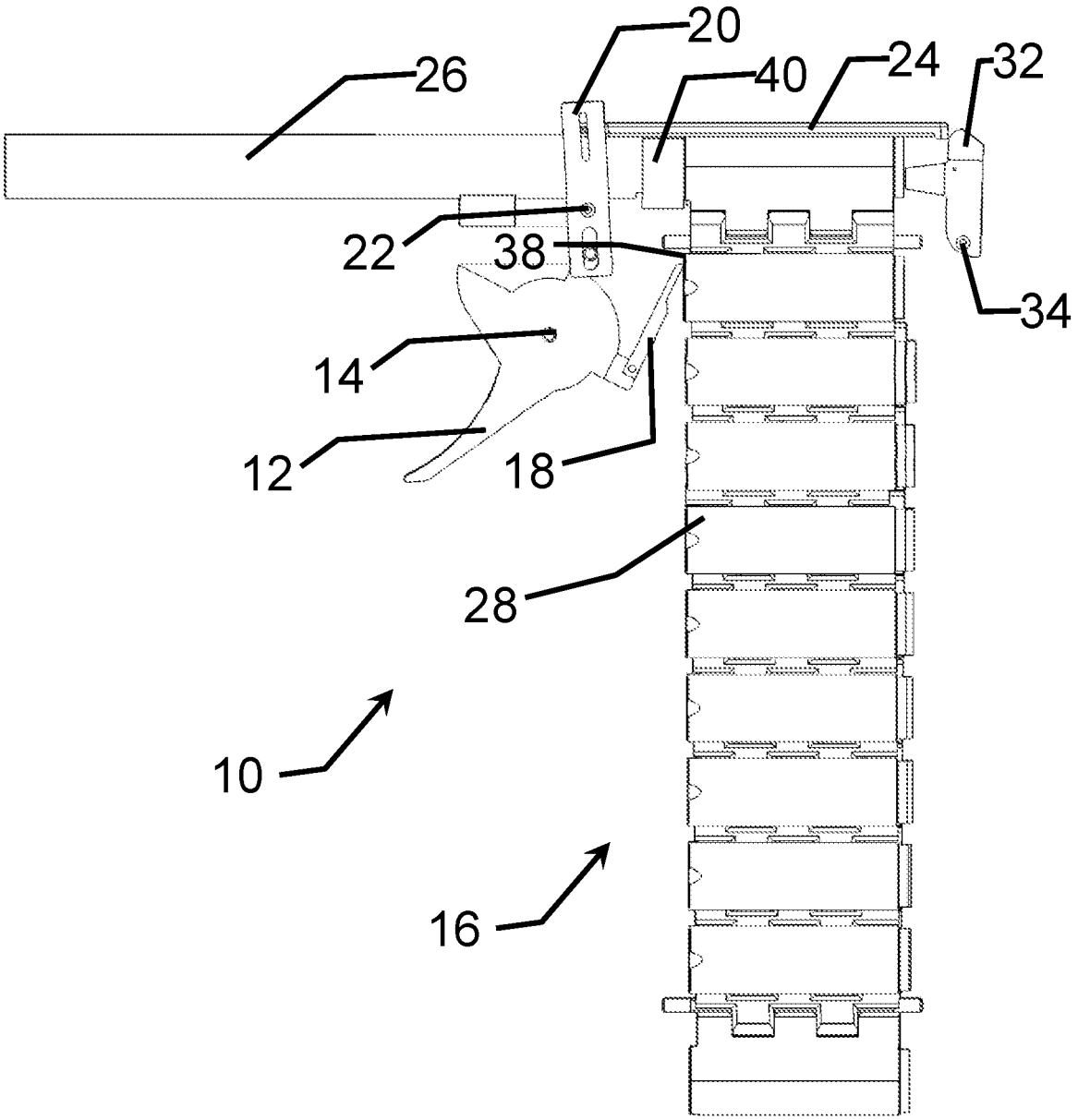
FIG. 4 is side view of one embodiment of the flat loop revolving assembly.

FIG. 4 illustrates a side view of the flat loop revolver 10 more clearly showing the loop advance lever 18 and the trigger mechanism 12.

Figure 5:
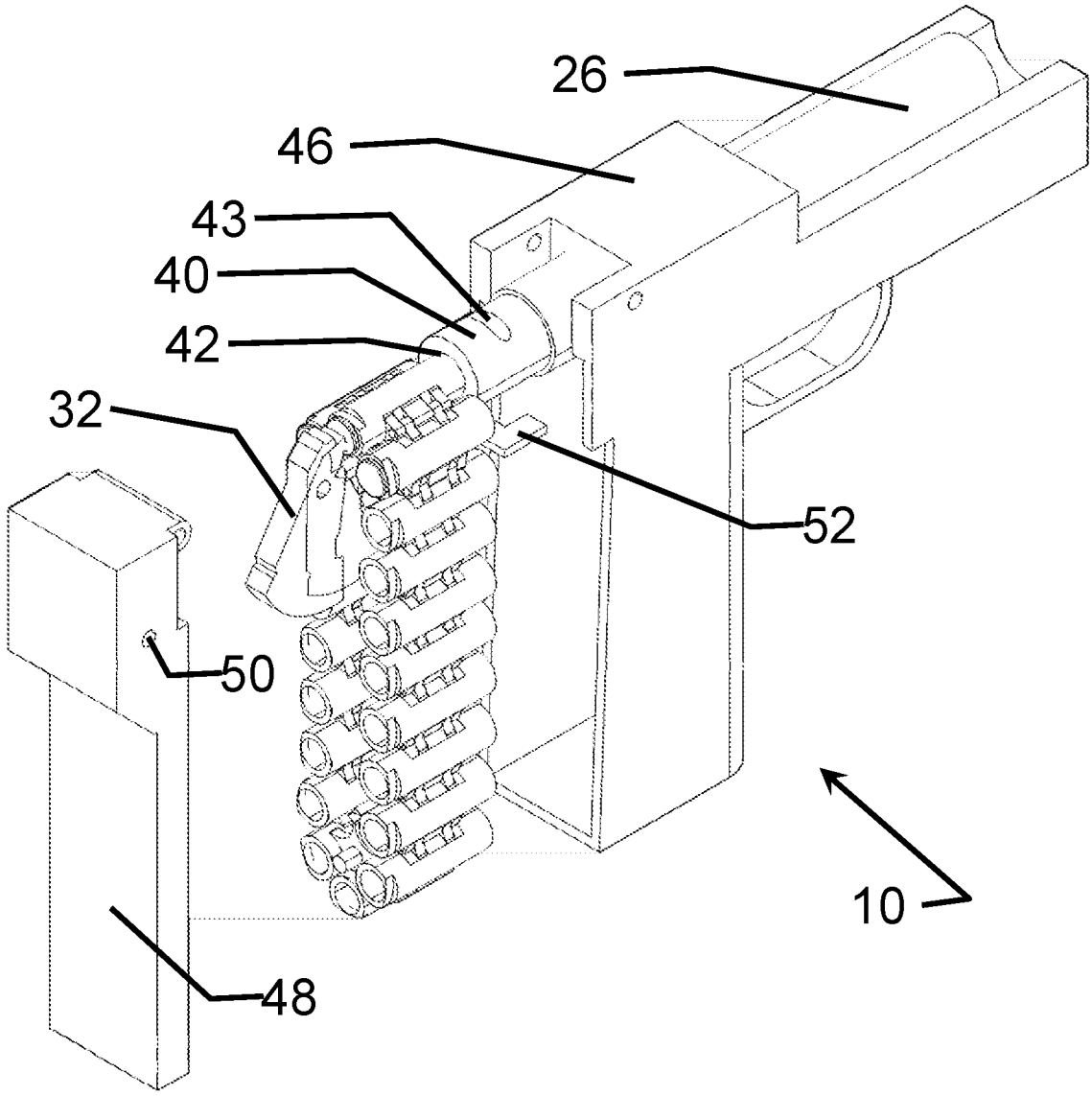
FIG. 5 is a perspective view of another embodiment of the flat loop revolving assembly.
Figure 6:
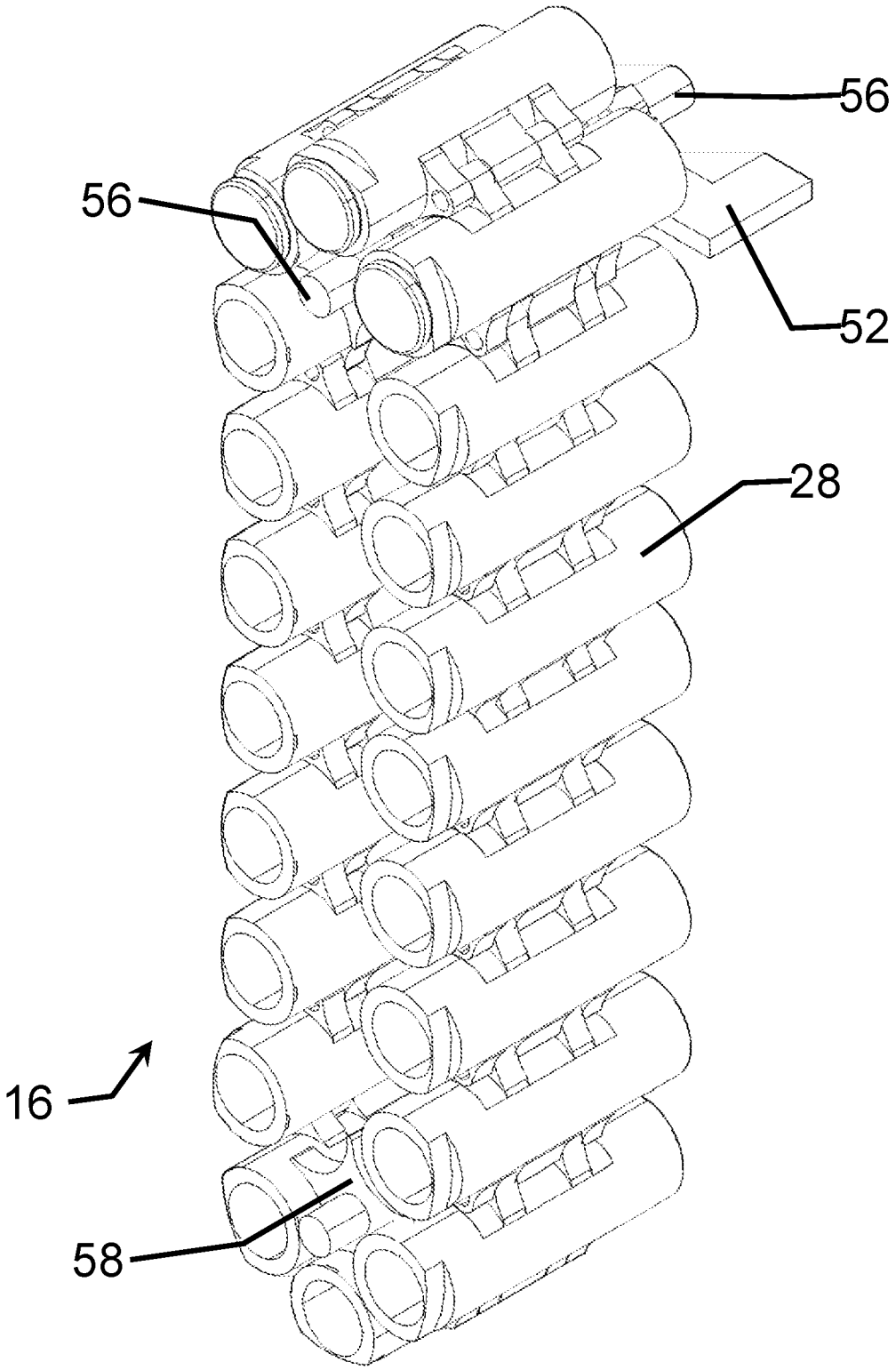
FIG. 6 is a perspective view of the linked cartridges in the FIG. 5 embodiment.
Figure 7:
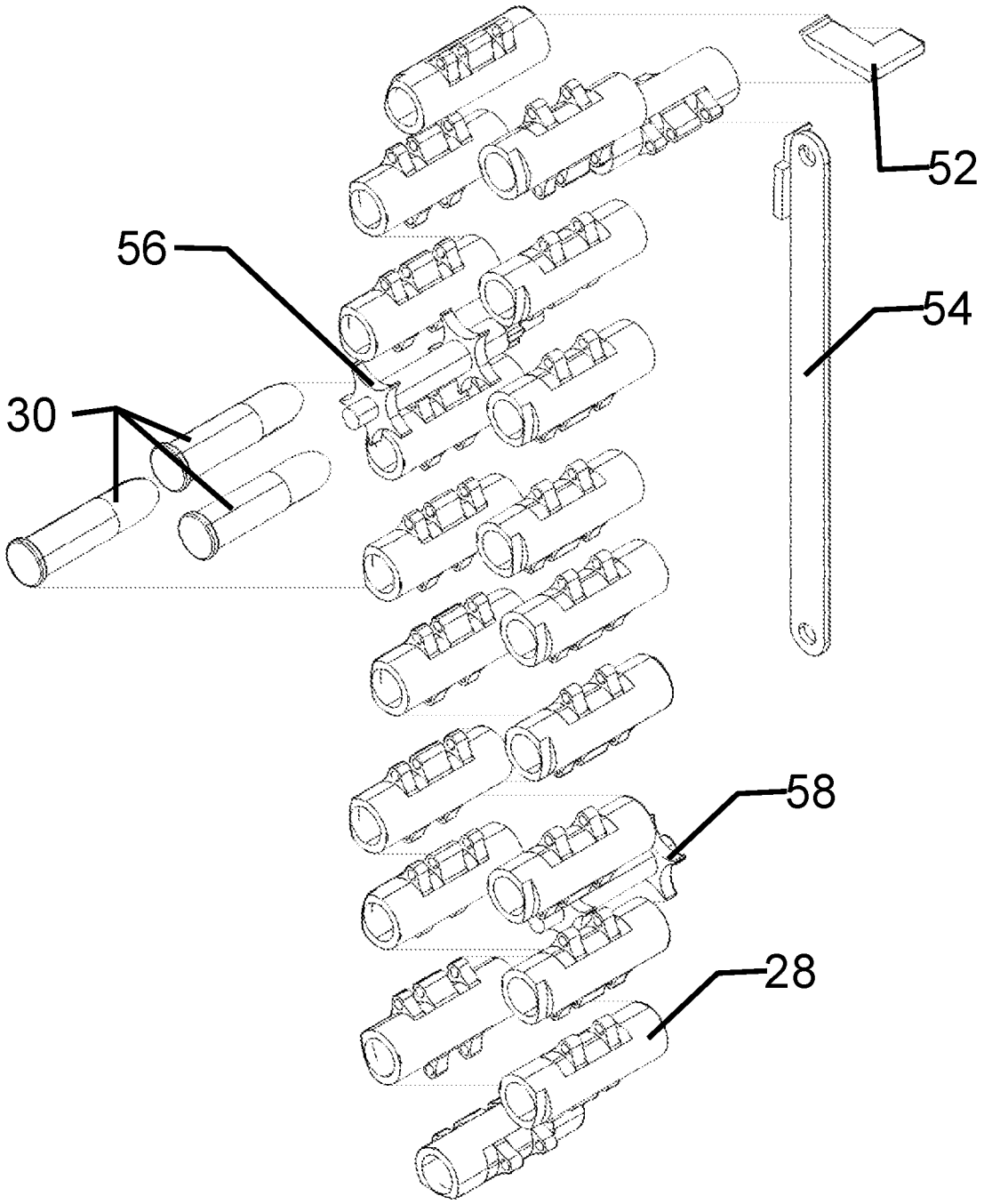
FIG. 7 is an exploded view of the flat loop components in the FIG. 5 embodiment.
Figure 8:
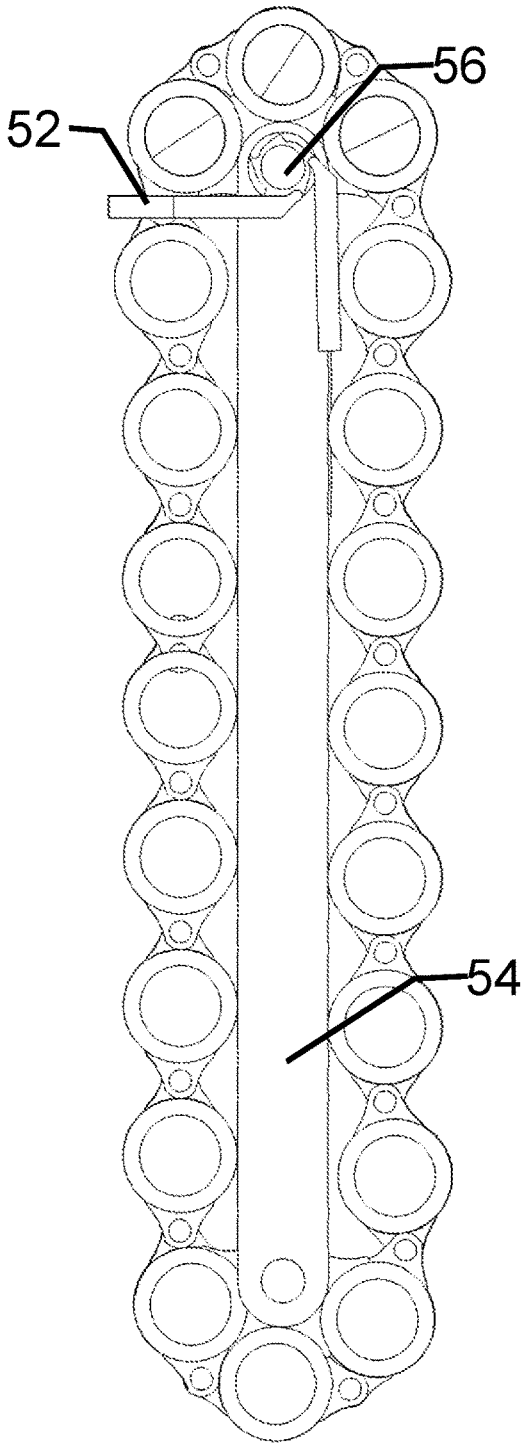
FIG. 8 is front view of the FIG. 5 embodiment.
Figure 9:
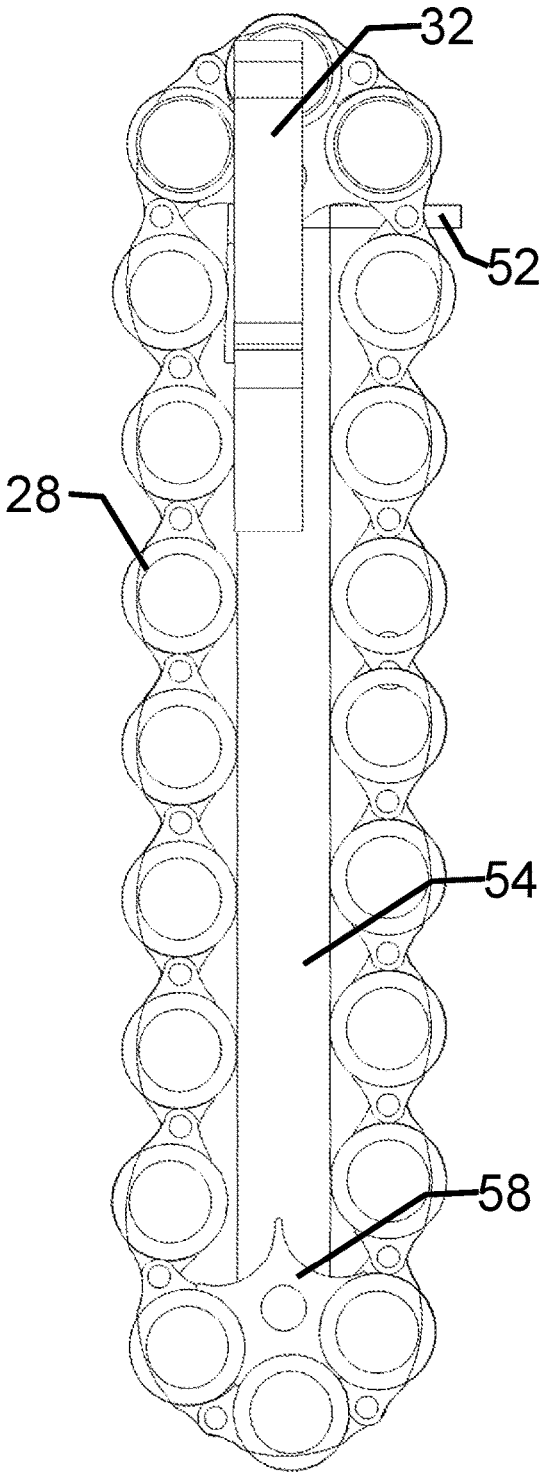
FIG. 9 is a rear view of the FIG. 5 embodiment.

FIGS. 1-4 depict the functional interior working parts of one embodiment of the flat loop revolver 10. Another embodiment of the interior working parts is shown in FIGS. 5-9, with an external stock 46, as shown in FIG. 5, encasing the working parts. The stock 46 can be constructed from steel, aluminum, polymer, composite and combinations of these materials, or other commonly used materials. The stock 46 can have opposing sides and a hinged rear door 48. The sides can be interlocked and machined to hold and secure pins for the trigger mechanism 12, hammer retractor lever 20, hammer retractor bar 24, flat loop 16 and hammer 32. A locking pin 50 and latches can hold the hinged rear door 48 closed and secure the opposing sides. The rear door 48 can swing out from the top to allow access to empty and reload the top chamber. There can be mounts for the trigger spring and hammer springs, as well as an optional counter spring attached to the trigger mechanism 12 to adjust trigger pull. The removal of the stock 46 pieces can allow total access to the internal working parts for cleaning and maintenance. Sights (not shown) of various standard configurations and grips can be added to the stock 46 as desired. Overall exterior dimensions of a typical .22LR flat loop revolver 10 model can be approximately 4"×5"×1", thereby being compact enough to be a concealable pocket or purse carry gun.

The embodiment shown in FIGS. 5-9 can have a trigger mechanism 12 configured to rotate about a trigger central pin and rotate a top sprocket 56 to move a loop advance bar 52 and a hammer retractor lever (not shown) similar to the embodiment of FIGS. 1-4. The loop advance bar 52 can be disposed between the top sprocket 56 and a flat loop 16.

The flat loop 16 in FIGS. 5-9 can have a sprocket retainer bar 54, a top sprocket 56, a bottom sprocket 58, and linked cartridges 30 spanning between the top and bottom sprockets. The flat loop 16 can be configured to revolve in parallel tracks into firing position in response to motion imposed by the loop advance bar 52.

The flat loop revolver 10 can be manufactured efficiently with high quality using forged, machined parts, hardened steel, graphite lubrication optional. Parts can be interlocked, with unchangeable sequencing. Channeled parts make loosening out-of-specification impossible. A chrome lined barrel 26 is preferred.

Cartridges 30 can be inserted individually by hand or simultaneously with loading tool. The number of chambers can be sized to fit specified grip handle dimensions. The flat loop 16 can be removable or permanent and secured inside grip handle. Slotted guides (not shown) in sides of handle can be synchronized with chamber alignment for proper loading.

The flat loop 16 can be configured similar to a "watch band" or chain magazine configuration, and can incorporate rollers, bearings or low friction pins within handle enclosure walls. A grooved track (not shown) in the stock handle can secure the pins and maintain the flat loop 16 shape. The flat loop revolver 10 is differentiated by having a more compact mechanism that will fit better than all known grips of a handgun and with far fewer parts, thereby making it more reliable and dependable to operate and much less difficult and expensive to make and maintain.

Reference numbers in FIGS. 1-9 correspond with components listed below:

| Reference Number | Component |
|---|---|
| 10 | Flat Loop Revolver |
| 12 | Trigger Mechanism |
| 14 | Trigger Central Pin |
| 16 | Flat Loop |
| 18 | Loop Advance Lever |
| 20 | Hammer Retractor Lever |
| 22 | HRL Pin |
| 24 | Hammer Retractor Bars |
| 26 | Barrel |
| 28 | Chambers |
| 30 | Cartridge |
| 32 | Hammer |
| 34 | Hammer Pivot Pin |
| 36 | Flat Loop Links |
| 38 | Advancing Lip |
| 40 | Blast Containment Ring |
| 42 | Positive Locking Mechanism |
| 43 | Gas Vent |
| 44 | Spring |
| 46 | Stock |
| 48 | Rear Door |
| 50 | Locking Pin |
| 52 | Loop Advance Bar |
| 54 | Sprocket Retainer Bar |
| 56 | Top Sprocket |
| 58 | Bottom Sprocket |

A functioning sequence for the flat loop revolver can include these steps: Latches (not shown) disengaged, rear door 48 opened; chambers 28 loaded with cartridges 30; rear door 48 closed and latched; hammer block (optional—not shown) engaged; safety (optional—not shown) engaged; safety (optional—not shown) disengaged; trigger mechanism 12 pulled, engages hammer retractor lever 20 that slides the hammer retractor bars 24 to push hammer 32 away from cartridge; trigger mechanism 12 simultaneously pushes loop advance lever 18 until it engages with an advancing lip 38 which advances the flat loop 16; a blast containment ring 40, attached to the hammer retractor bars 24, closes and seals gap between the chamber 28 and barrel 26; the loop advance lever 18 disengages from the advancing lip 38; the blast containment ring 40 also acts as a positive locking mechanism 42 assuring alignment of cartridge and barrel; the positive locking mechanism 42 is held in place with spring as the hammer retractor bars 24 advance and fully retract hammer 32; a hammer block (optional) can be disengaged; the hammer 32, travelling on arc, slips below hammer retractor bars 24 and, driven by spring (not shown), strikes and fires round; trigger mechanism 12 is retracted as driven by return spring (not shown); the hammer retractor bars 24 pushes the top of the hinged hammer 32 over on return to original position; hammer retractor bars 24, hammer retractor lever 20, hammer 32 and trigger mechanism 12 return to original position; hammer 32 remains in contact with spent cartridge holding flat loop 16 in place; rear door 48 opened, empty shells extracted manually or with optional extractor; flat loop 16 returned to starting, original position.

The invention has been described with reference to the preferred embodiments without limit thereto. One of skill in the art would realize additional embodiments and improvements which are not specifically stated but which are within the meets and bounds of the claims appended hereto.

The invention claimed is:

1. A flat loop revolving firearm assembly, comprising:

a trigger mechanism configured to rotate about a trigger central pin and move a loop advance lever and a hammer retractor lever, the loop advance lever disposed between the trigger mechanism and a flat loop, the hammer retractor lever disposed between the trigger mechanism and at least one hammer retractor bar;

the at least one hammer retractor bar slidingly disposed between the hammer retractor lever and a hammer, the hammer retractor bar configured to slide and contact the hammer thereby rotating the hammer to a cocked position and releasing the hammer to fire a cartridge removably disposed in a firing position chamber;

the flat loop comprising a plurality of flat loop links, each link comprising an advancing lip and a chamber configured to revolve in parallel tracks into a firing position in response to motion imposed by the loop advance lever;

a barrel aligned with the firing position chamber; and a gun stock encasing the flat loop revolving firearm assembly.

2. The flat loop revolving firearm assembly of claim 1, further comprising a trigger safety and a trigger spring.

3. The flat loop revolving firearm assembly of claim 1, further comprising a blast containment ring positioned between a top cartridge and the barrel.

4. The flat loop revolving firearm assembly of claim 3, wherein the blast containment cartridge further comprises a positive locking mechanism.

5. The flat loop revolving firearm assembly of claim 3, wherein the blast containment cartridge further comprises a gas vent.

6. The flat loop revolving firearm assembly of claim 1, wherein the trigger mechanism further comprises a counter spring configured to adjust trigger pull.

7. The flat loop revolving firearm assembly of claim 1, wherein the gun stock further comprises a ramp configured to disengage the top chamber into a firing position.

8. The flat loop revolving firearm assembly of claim 1, wherein the hammer is configured to strike the cartridge in either a rim fire or center fire position.

9. The flat loop revolving firearm assembly of claim 1, wherein the flat loop and gun stock are configured for firing rifle or shotgun cartridges.

10. A flat loop revolving firearm assembly, comprising:

a trigger mechanism configured to rotate about a trigger central pin and rotate a top sprocket to move a loop advance bar and a hammer retractor lever, the loop advance bar disposed between the top sprocket and a flat loop, the hammer retractor lever disposed between the trigger mechanism and at least one hammer retractor bar;

the at least one hammer retractor bar slidingly disposed between the hammer retractor lever and a hammer, the hammer retractor bar configured to slide and contact the hammer thereby rotating the hammer to a cocked position and releasing the hammer to fire a cartridge removably disposed in a firing position chamber;

the flat loop comprising a sprocket retainer bar, the top sprocket, a bottom sprocket, and linked cartridges spanning between the top and bottom sprockets configured to revolve in parallel tracks into firing position in response to motion imposed by the loop advance bar;

a barrel aligned with the firing position chamber; and a gun stock encasing the flat loop revolving firearm assembly.

11. The flat loop revolving firearm assembly of claim 10, further comprising a trigger safety and a trigger spring.

12. The flat loop revolving firearm assembly of claim 10, further comprising a blast containment ring positioned between a top cartridge and the barrel.

13. The flat loop revolving firearm assembly of claim 12, wherein the blast containment cartridge further comprises a positive locking mechanism.

14. The flat loop revolving firearm assembly of claim 12, wherein the blast containment cartridge further comprises a gas vent.

15. The flat loop revolving firearm assembly of claim 10, wherein the trigger mechanism further comprises a counter spring configured to adjust trigger pull.

16. The flat loop revolving firearm assembly of claim 10, wherein the gun stock further comprises a ramp configured to disengage the top chamber into a firing position.

17. The flat loop revolving firearm assembly of claim 10, wherein the hammer is configured to strike the cartridge in either a rim fire or center fire position.

18. The flat loop revolving firearm assembly of claim 10, wherein the flat loop and gun stock are configured for firing rifle or shotgun cartridges.

19. The flat loop revolving firearm assembly of claim 10, wherein the gun stock comprises steel, aluminum, polymer, composite and combinations thereof.

20. A flat loop revolving firearm assembly, consisting essentially of:

a trigger mechanism configured to rotate about a trigger central pin and move a loop advance lever and a hammer retractor lever, the loop advance lever disposed between the trigger mechanism and a flat loop, the hammer retractor lever disposed between the trigger mechanism and at least one hammer retractor bar;

the at least one hammer retractor bar slidingly disposed between the hammer retractor lever and a hammer, the hammer retractor bar configured to slide and contact the hammer thereby rotating the hammer to a cocked position and releasing the hammer to fire a cartridge removably disposed in a firing position chamber;

the flat loop comprising a plurality of flat loop links, each link comprising an advancing lip and a chamber configured to revolve in parallel tracks into a firing position in response to motion imposed by the loop advance lever;

a barrel aligned with the firing position chamber; and a gun stock encasing the flat loop revolving firearm assembly.

* * * * *